US009340022B1

(12) United States Patent
Fujii et al.

(10) Patent No.: US 9,340,022 B1
(45) Date of Patent: May 17, 2016

(54) LIQUID DISCHARGING SUBSTRATE, PRINTHEAD, AND PRINTING APPARATUS

(71) Applicant: CANON KABUSHIKI KAISHA, Tokyo (JP)

(72) Inventors: Kazunari Fujii, Tokyo (JP); Takaaki Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/886,405

(22) Filed: Oct. 19, 2015

(30) Foreign Application Priority Data

Nov. 5, 2014 (JP) ..... 2014-225435

(51) Int. Cl.
*B41J 2/14* (2006.01)
*B41J 2/16* (2006.01)

(52) U.S. Cl.
CPC ..... *B41J 2/1433* (2013.01); *B41J 2/14072* (2013.01); *B41J 2002/14491* (2013.01)

(58) Field of Classification Search
CPC ..... B41J 2/14072; B41J 2/17526; B41J 2002/14491
See application file for complete search history.

(56) References Cited

U.S. PATENT DOCUMENTS 8,779,806 B2 * 7/2014 Tseng ..... H03K 19/00361 326/80
8,829,971 B2 * 9/2014 Yamazaki ..... H03L 5/00 327/333

FOREIGN PATENT DOCUMENTS

JP 2005-104142 A 4/2005

* cited by examiner

*Primary Examiner* — Juanita D Jackson
(74) *Attorney, Agent, or Firm* — Fitzpatrick, Cella, Harper & Scinto

(57) ABSTRACT

A liquid discharging substrate comprising discharging units, a first pad arranged on a first side, a second pad arranged on a second side, a signal generating unit arranged between the first pad and the second pad, level shifters, for shifting a level of a signal generated by the signal generating unit to output the signal to the discharging units, arranged between the signal generating unit and the second pad, a first wiring line for supplying the signal generating unit with a first reference voltage received by the first pad, and a second wiring line for supplying the level shifters with the second reference voltage received by the second pad, wherein the first wiring line and the second wiring line are isolated from each other between the signal generating unit and the level shifters in a planar view.

13 Claims, 9 Drawing Sheets

LIQUID DISCHARGING SUBSTRATE, PRINTHEAD, AND PRINTING APPARATUS

BACKGROUND OF THE INVENTION

1. Field of the Invention

The present invention relates to a liquid discharging substrate, a printhead, and a printing apparatus.

2. Description of the Related Art

A printing apparatus includes a printhead. For example, in an inkjet printing apparatus, a plurality of nozzles for discharging ink (printing material) are provided in the printhead. Japanese Patent Laid-Open No. 2005-104142 exemplifies a printhead substrate including a discharging unit, or a printing unit, corresponding to each nozzle, a signal generating unit that generates a signal based on printing data, and a level shifter that shifts the level of the generated signal and outputs the signal to the discharging unit.

The discharging unit includes, for example, a printing element (for example, electrothermal transducer), and a switching element (for example, transistor) that is connected to the printing element and is turned on in response to a signal from the level shifter. The discharging unit is driven by controlling the switching element and supplying a current to the printing element. When the discharging unit is driven, noise may be generated on the power supply line of the level shifter owing to the control of the switching element.

The signal generating unit receives, for example, a voltage (for example, 3.3 to 5 [V]) for a logic circuit. The level shifter receives, for example, a voltage (for example, 12 [V]) that is larger in voltage value than the voltage for the logic circuit and is used to shift the level of a signal from the signal generating unit. Both the signal generating unit and the level shifter receive, for example, a common ground voltage (0 [V]).

In this arrangement, noise of the ground voltage generated in the level shifter at the time of driving the discharging unit propagates to the signal generating unit through a wiring line for supplying the ground voltage, and may cause the malfunction of the signal generating unit. When the number of discharging units (the number of nozzles) is increased, the number of switching elements is also increased, so the noise becomes a serious problem. Note that Japanese Patent Laid-Open No. 2005-104142 does not consider this noise.

SUMMARY OF THE INVENTION

The present invention has been made in consideration of the above-described problem by the present inventor, and provides a technique advantageous for reducing the influence of noise generated in a level shifter on a signal generating unit in a printhead substrate.

One of the aspects of the present invention provides a liquid discharging substrate including a plurality of discharging units arrayed on a substrate having a first side and a second side opposite to the first side, comprising a first pad configured to receive a first reference voltage, the first pad being arranged on the first side of the substrate, a second pad configured to receive a second reference voltage equal to the first reference voltage, the second pad being arranged on the second side of the substrate, a signal generating unit configured to generate a signal for driving the plurality of discharging units, the signal generating unit being arranged between the first pad and the second pad, a plurality of level shifters configured to shift a level of the signal from the signal generating unit and output the signal to the plurality of discharging units, the plurality of level shifters being arranged between the signal generating unit and the second pad, a first wiring line configured to supply the first reference voltage received by the first pad to the signal generating unit, and a second wiring line configured to supply the second reference voltage received by the second pad to the plurality of level shifters, wherein the first wiring line and the second wiring line are isolated from each other between the signal generating unit and the plurality of level shifters when viewed from an upper side with respect to an upper surface of the substrate.

Further features of the present invention will become apparent from the following description of exemplary embodiments with reference to the attached drawings.

DESCRIPTION OF THE EMBODIMENTS

Example of Overall Arrangement of Printing Apparatus

Figure 1A:
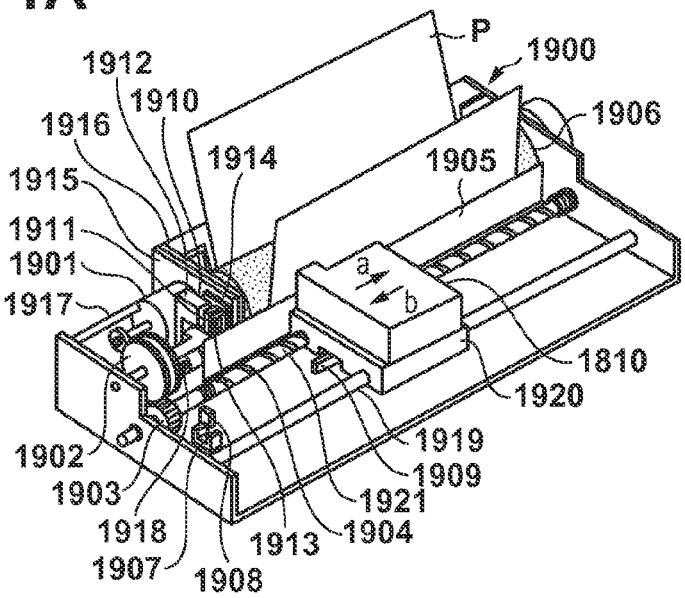
FIGS. 1A to 1D are views for explaining an example of the arrangement of a printing apparatus.

FIG. 1A exemplifies the internal arrangement of an inkjet printing apparatus 1900 typified by a printer, a facsimile, a copy machine, or the like. The printing apparatus 1900 includes a printhead 1810 that discharges ink (printing material) to a printing medium P such as printing paper. The printhead 1810 is mounted on a carriage 1920, and the carriage 1920 is attached to a lead screw 1921 having a helical groove 1904. The lead screw 1921 can rotate in synchronism with rotation of a driving motor 1901 via driving force transfer gears 1902 and 1903. Along with this, the printhead 1810 can move in a direction indicated by an arrow a or b along a guide 1919 together with the carriage 1920.

The printing medium P is pressed by a paper press plate 1905 in the carriage moving direction and is fixed to a platen 1906. The printing apparatus 1900 reciprocates the printhead 1810 and prints on the printing medium P conveyed on the platen 1906 by a conveyance unit (not shown).

The printing apparatus 1900 confirms the position of a lever 1909 provided on the carriage 1920 via photocouplers 1907 and 1908, and switches the rotational direction of the driving motor 1901. A support member 1910 supports a cap member 1911 for covering the ink orifices (nozzles) of the printhead 1810. A suction means 1912 performs recovery processing of the printhead 1810 by sucking the interior of the cap member 1911 via an intra-cap opening 1913. A lever 1917 is provided to start recovery processing by suction, and moves along with movement of a cam 1918 engaged with the carriage 1920. A driving force from the driving motor 1901 is controlled by a well-known transfer means such as clutch switching.

A main body support plate 1916 supports a moving member 1915 and a cleaning blade 1914. The moving member 1915 moves the cleaning blade 1914, and performs recovery processing of the printhead 1810 by wiping. A printing control unit (not shown) is also provided in the printing apparatus 1900, and controls driving of each mechanism described above.

Figure 1B:
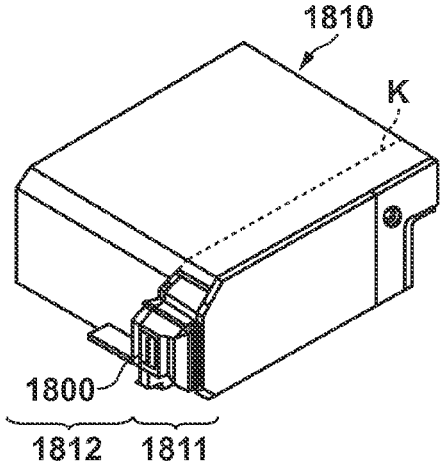

FIG. 1B exemplifies the outer appearance of the printhead 1810. The printhead 1810 can include a printhead unit 1811 including a plurality of nozzles 1800, and an ink tank 1812 that holds ink to be supplied to the printhead unit 1811. The ink tank 1812 and the printhead unit 1811 can be isolated at, for example, a broken line K, and the ink tank 1812 can be changed. The printhead 1810 includes an electrical contact (not shown) for receiving an electrical signal from the carriage 1920, and discharges ink in accordance with the electrical signal to perform the above-described printing. The ink tank 1812 includes, for example, a fibrous or porous ink holding member (not shown), and can hold ink by the ink holding member.

Figure 1C:
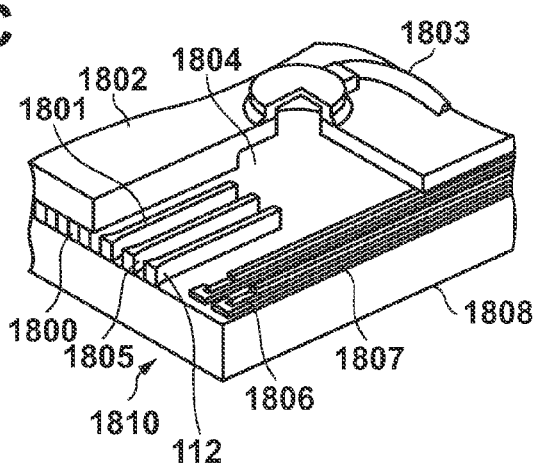

FIG. 1C exemplifies the internal arrangement of the printhead 1810. The printhead 1810 includes a substrate 1808, channel wall members 1801 that are arranged on the substrate 1808 and form channels 1805, and a top plate 1802 having an ink supply path 1803. As printing elements, heaters 1806 (electrothermal transducers) are arrayed on the printhead substrate of the printhead 1810 in correspondence with the respective nozzles 1800. When a driving element (switching element such as a transistor) provided in correspondence with each heater 1806 is turned on, the heater 1806 is driven to generate heat.

Ink from the ink supply path 1803 is stored in a common ink chamber 1804, and supplied to each nozzle 1800 through the corresponding channel 1805. The ink supplied to each nozzle 1800 is discharged from the nozzle 1800 by driving the heater 1806 corresponding to the nozzle 1800 to generate heat.

Figure 1D:
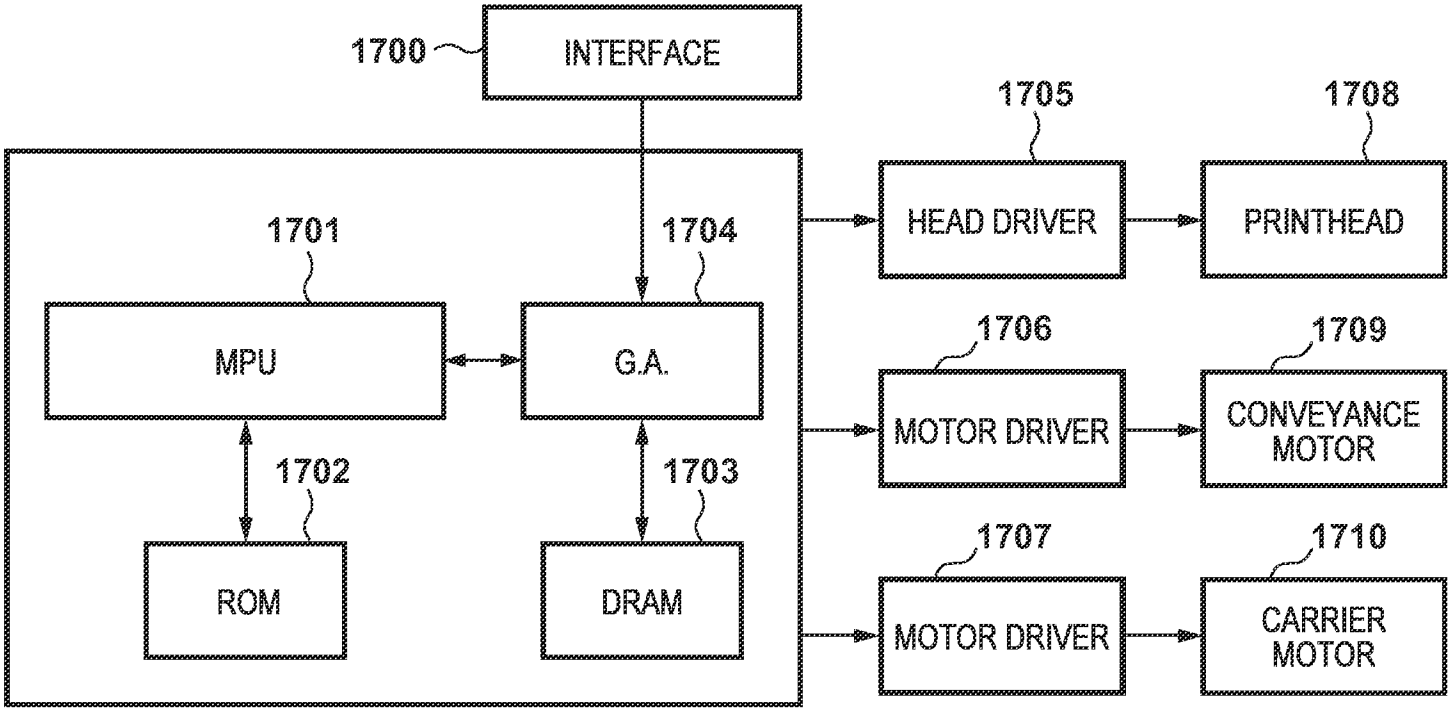

FIG. 1D exemplifies the system arrangement of the printing apparatus 1900. The printing apparatus 1900 includes an interface 1700, an MPU 1701, a ROM 1702, a RAM 1703, and a gate array 1704. The interface 1700 receives a printing signal. The ROM 1702 stores a control program to be executed by the MPU 1701. The RAM 1703 saves the above-mentioned printing signal, and various data such as printing data supplied to the printhead 1708. The gate array 1704 performs supply control of printing data to the printhead 1708, and controls data transfer between the interface 1700, the MPU 1701, and the RAM 1703.

The printing apparatus 1900 further includes a printhead driver 1705, motor drivers 1706 and 1707, a conveyance motor 1709, and a carrier motor 1710. The carrier motor 1710 conveys a printhead 1708. The conveyance motor 1709 conveys the printing medium P. The printhead driver 1705 drives the printhead 1708. The motor drivers 1706 and 1707 drive the conveyance motor 1709 and the carrier motor 1710, respectively.

When a printing signal is input to the interface 1700, it can be converted into printing data for printing between the gate array 1704 and the MPU 1701. Each mechanism performs a desired operation in accordance with the printing data, thus performing the above-described printing.

First Embodiment

Figure 2A:
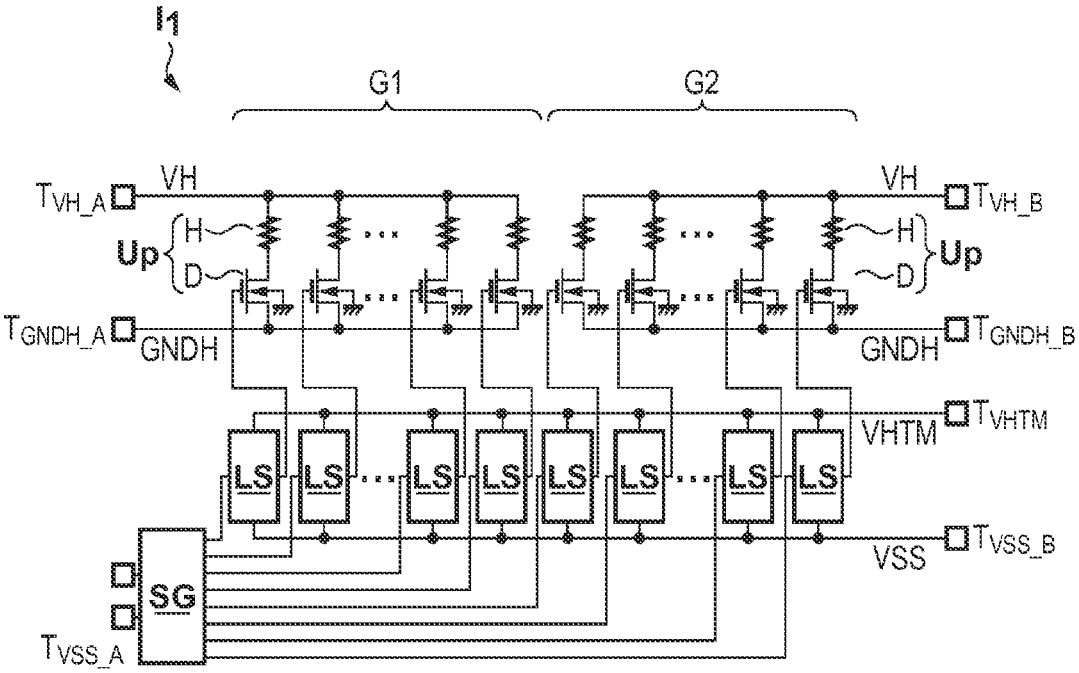
FIGS. 2A and 2B are views for explaining an example of the arrangement of a printhead substrate.

FIG. 2A shows an example of the arrangement of a printhead substrate $I_1$ according to the first embodiment. The printhead substrate $I_1$ includes, for example, a plurality of discharging units $U_P$, a signal generating unit SG, and a plurality of level shifters LS.

Each of the plurality of discharging units $U_P$ includes, for example, a heater H and a transistor D. As the transistor D, a high-breakdown voltage transistor such as an n-channel DMOS transistor is used. The transistor D is turned on to drive the heater H (more specifically, supply a current to the heater H). The plurality of heaters H are driven by, for example, the time-divisional driving method, and are driven in respective time-divisional blocks (to be simply referred to as "blocks").

Based on an externally received printing job or printing data corresponding to it, the signal generating unit SG generates a signal for driving the heater H. More specifically, the signal generating unit SG includes, for example, a shift register and a latch circuit. The signal generating unit SG receives a clock signal, a latch signal, and other control signals, and generates, based on the printing job or the printing data, a signal for driving the heater H.

The plurality of level shifters LS correspond to the plurality of discharging units $U_P$. Each level shifter LS shifts the level of a signal from the signal generating unit SG, and outputs the level-shifted signal to the corresponding discharging unit $U_P$. For example, the level shifter LS converts a signal of a 3.3 to 5 [V]-signal level received from the signal generating unit SG into a signal of a 12 [V]-signal level, and supplies the converted signal to the gate of the transistor D of the corresponding discharging unit $U_P$.

With this arrangement, a current is supplied to the heater H to discharge ink from a nozzle corresponding to the heater H and print an ink dot on a printing medium. Note that this may be called driving the heater, driving the discharging unit, or driving the nozzle.

The printhead substrate $I_1$ further includes, for example, electrode pads $T_{VH_A}$, $T_{VH_B}$, $T_{GNDH_A}$, $T_{GNDH_B}$, $T_{VHTM}$, $T_{VSS_A}$ and $T_{VSS_B}$.

The pads $T_{VH_A}$ and $T_{VH_B}$ receive from the outside a voltage VH (for example, 24 [V]) for driving the heater H. The pad $T_{VH_A}$ supplies the voltage VH through a wiring line to the individual discharging units $U_P$ of a first group G1 (left side in FIG. 2A) out of the plurality of discharging units $U_P$. The pad $T_{VH_B}$ supplies the voltage VH through a wiring line to the individual discharging units $U_P$ of a second group G2 (right side in FIG. 2A) out of the plurality of discharging units $U_P$. A relatively large amount of current is supplied to the plurality of discharging units $U_P$, and a voltage drop or noise may be generated on a power supply line for propagating the voltage VH. In this arrangement, therefore, the plurality of discharging units $U_P$ are divided into the two groups G1 and G2, and the voltage VH is supplied to the two groups through two paths independent of each other. This arrangement reduces the voltage drop or noise.

Similarly, the pads $T_{GNDH_A}$ and $T_{GNDH_B}$ receive from the outside a reference voltage GNDH (0 [V]) for grounding that corresponds to the voltage VH. The pad $T_{GNDH_A}$ supplies the voltage GNDH through a wiring line to the individual discharging units $U_P$ of the group G1. The pad $T_{GNDH_B}$ supplies the voltage GNDH through a wiring line to the individual discharging units $U_P$ of the group G2.

The pad $T_{VHTM}$ receives from the outside a voltage VHTM (for example, 12 [V]) for level shift, and supplies the voltage VHTM to the plurality of level shifters LS through a wiring line.

The pads $T_{VSS_A}$ and $T_{VSS_B}$ receive from the outside a reference voltage VSS (for example, 0 [V]) for grounding. The pad $T_{VSS_A}$ supplies the voltage VSS through a wiring line to the signal generating unit SG. The pad $T_{VSS_B}$ supplies the voltage VSS through a wiring line to the plurality of level shifters LS. A relatively large amount of current is supplied to the plurality of discharging units $U_P$, and a voltage drop or noise may be generated on a power supply line for propagating the voltage GNDH. For this reason, the voltages VSS and GNDH, both of which are reference voltages (also called "ground voltages") for grounding, are electrically isolated from each other on the printhead substrate $I_1$.

Note that the pad $T_{VH_A}$ and the like include metal members that receive a voltage and are electrically connected to wiring lines for propagating the voltage. In addition to the above-described pad $T_{VH_A}$ and the like, the printhead substrate $I_1$ can include a pad (not shown) for receiving a voltage VDD (for example, 3.3 to 5 [V]) to be supplied to the signal generating unit SG and the plurality of level shifters LS. In addition, the printhead substrate $I_1$ can further include a pad (not shown) for receiving a printing job or printing data corresponding to it.

Figure 2B:
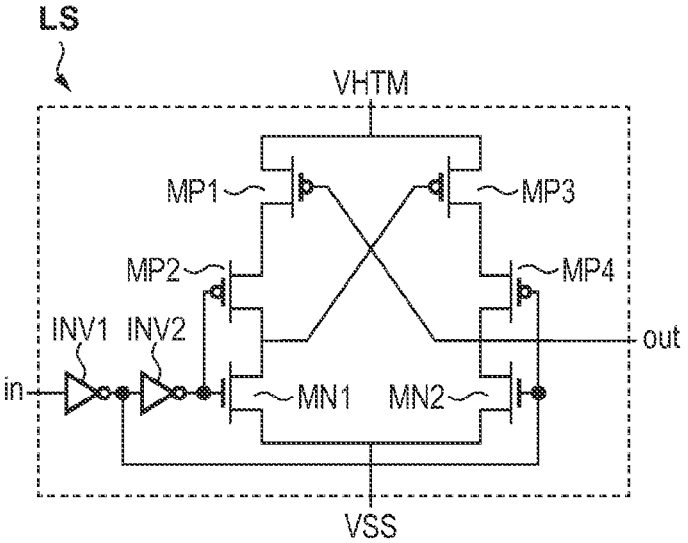

FIG. 2B shows an example of the circuit arrangement of the level shifter LS. The level shifter LS includes, for example, inverters INV1 and INV2, NMOS transistors MN1 and MN2, and PMOS transistors MP1 to MP4.

Each of the inverters INV1 and INV2 is arranged between a power supply line for propagating the voltage VDD, and a power supply line for propagating the voltage VSS. The transistors MN1, MP1, and MP2 are arranged in series to form a current path between a power supply line for propagating the voltage VHTM, and the power supply line for propagating the voltage VSS. The transistors MN2, MP3, and MP4 are arranged in series to form a current path between the power supply line for propagating the voltage VHTM, and the power supply line for propagating the voltage VSS.

The inverter INV1 inverts a signal received at an input terminal in, outputs the inverted signal to the inverter INV2, and supplies it to the gates of the transistors MN2 and MP4. The inverter INV2 inverts the signal from the inverter INV1, and supplies it to the gates of the transistors MN1 and MP2. The node between the transistor MN1 and the transistor MP2 is connected to the gate of the transistor MP3. The node between the transistor MN2 and the transistor MP4 is connected to the gate of the transistor MP1, and also connected to an output terminal out.

With this arrangement, the level shifter LS shifts the level of a signal received at the input terminal in, and outputs the level-shifted signal from the output terminal out.

Figure 3:
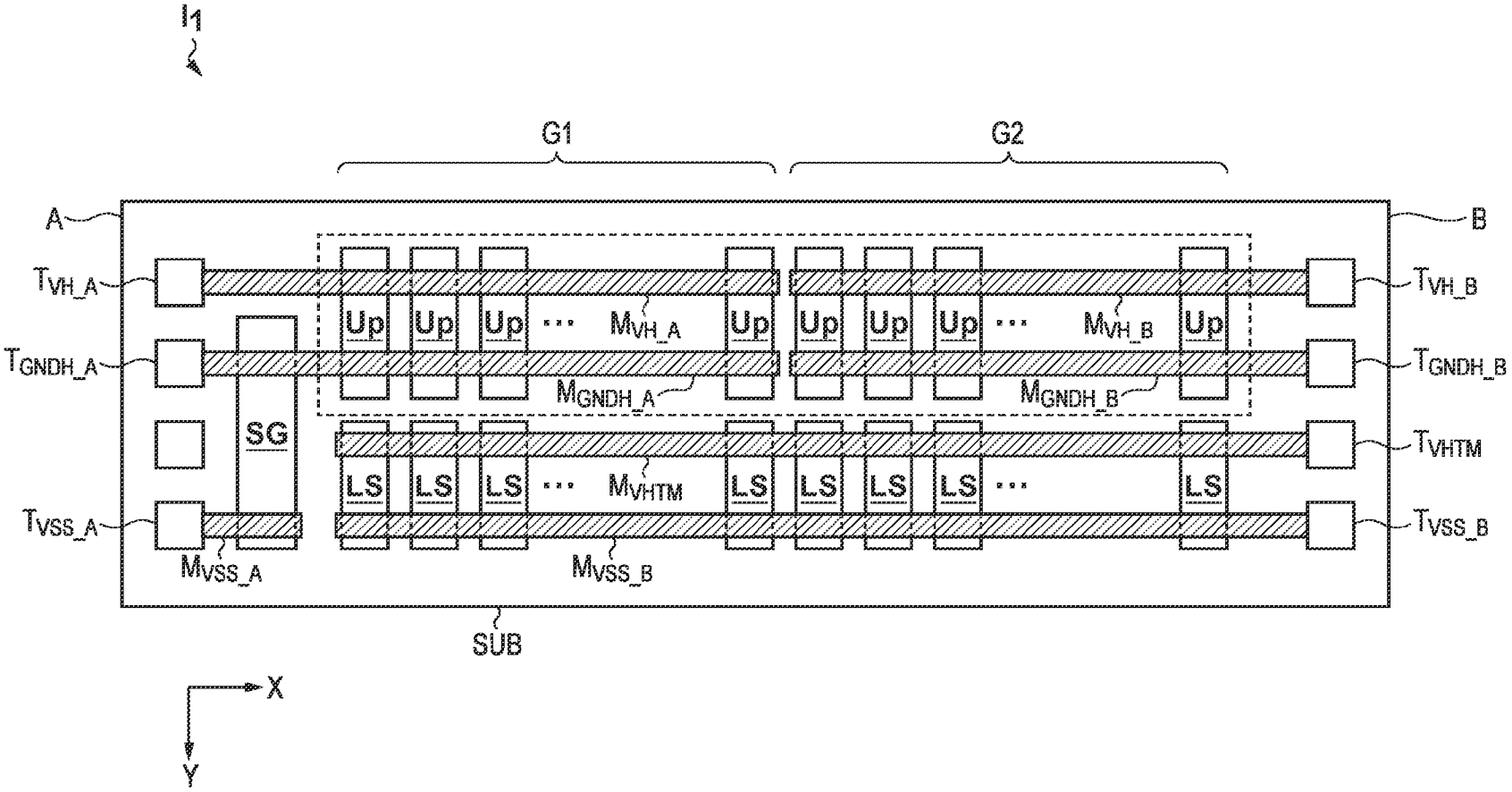
FIG. 3 is a view for explaining an example of the layout of a printhead substrate.

FIG. 3 is a schematic view showing the upper surface layout of the printhead substrate $I_1$. The plurality of discharging units $U_P$, the signal generating unit SG, and the plurality of level shifters LS described above are arranged on a substrate SUB formed from a semiconductor or the like (for example, silicon). The plurality of discharging units $U_P$ and the plurality of level shifters LS are arrayed in the X direction. Each level shifter LS is arranged to be adjacent to the corresponding discharging unit $U_P$ in the Y direction that is a direction perpendicular to the X direction.

The substrate SUB has sides A and B that are parallel to the Y direction and are opposite to each other. The pads $T_{VH_A}$, $T_{GNDH_A}$ and $T_{VSS_A}$ are arranged on the side A along the side A. The pads $T_{VH_B}$, $T_{GNDH_B}$ $T_{VHTM}$, and $T_{VSS_B}$ are arranged on the side B along the side B. The signal generating unit SG is arranged between a region where the pads $T_{VH_A}$, $T_{GNDH_A}$, and $T_{VSS_A}$ are arranged, and a region where the plurality of discharging units $U_P$ and the plurality of level shifters LS are arranged, when viewed from the upper side (when viewed from the upper side with respect to the upper surface of the substrate SUB).

The pad $T_{VH_A}$ is electrically connected to a wiring line $M_{VH_A}$, and supplies the voltage VH to the individual discharging units $U_P$ of the group G1 (left half in FIG. 3) through the wiring line $M_{VH_A}$. In contrast, the pad $T_{VH_B}$ is electrically connected to a wiring line $M_{VH_B}$, and supplies the voltage VH to the individual discharging units $U_P$ of the group G2 (right half in FIG. 3) through the wiring line $M_{VH_B}$. Similarly, the pads $T_{GNDH_A}$ and $T_{GNDH_B}$ are electrically connected to wiring lines $M_{GNDH_A}$ and $M_{GNDH_B}$, respectively, and supply the voltage GNDH to the individual discharging units $U_P$ of the groups G1 and G2 through the wiring lines $M_{GNDH_A}$ and $M_{GNDH_B}$.

As described above, a relatively large amount of current is supplied to the plurality of discharging units $U_P$, and a voltage drop or noise may be generated on a power supply line for propagating the voltage VH or GNDH. The voltages VH and GNDH are supplied to the plurality of discharging units $U_P$ from one end and the other end.

The pad $T_{VSS_A}$ is electrically connected to a wiring line $M_{VSS_A}$, and supplies the voltage VSS to the signal generating unit SG through the wiring line $M_{VSS_A}$. The pads $T_{VHTM}$ and $T_{VSS_B}$ are electrically connected to wiring lines $M_{VHTM}$ and $M_{VSS_B}$, respectively, and supply the voltages VHTM and VSS to the plurality of level shifters LS through the wiring lines $M_{VHTM}$ and $M_{VSS_B}$. The wiring lines $M_{VSS_A}$ and $M_{VSS_B}$ are isolated from each other between the signal generating unit SG and the plurality of level shifters LS when viewed from the upper side.

Since a relatively large amount of current is supplied to the discharging unit $U_P$, the transistor D is provided at a relatively large size. Thus, when controlling the transistor D, noise is generated on the power supply line of the corresponding level shifter LS. Also, when performing printing by the time-divisional driving method, the individual transistors D of the respective blocks are almost simultaneously controlled. If the number of discharging units $U_P$ is increased (the number of transistors D is increased) in order to increase the printing speed, noise generated on the power supply line of the plurality of level shifters LS also increases. This may become a more serious problem when the operating frequency of the printhead substrate $I_1$ is increased.

According to this embodiment, the wiring line $M_{VSS_A}$ and $M_{VSS_B}$, which are wiring lines for propagating the voltage VSS, are isolated from each other between the signal generating unit SG and the plurality of level shifters LS when viewed from the upper side. Therefore, the signal generating unit SG is hardly influenced by noise generated on the power supply line of the plurality of level shifters LS.

It is preferable that the wiring line $M_{VSS_B}$ for supplying the voltage VSS to the plurality of level shifters LS is arranged not to overlap the signal generating unit SG when viewed from the upper side. This can reduce the parasitic capacitance between the wiring line $M_{VSS_B}$ and the signal generating unit SG, and further reduce the influence of the aforementioned noise.

Typically, a plurality of wiring layers can be arranged on the substrate SUB. The wiring line $M_{VSS_B}$ is preferably constituted by a metal pattern arranged on the top layer out of the plurality of wiring layers. The metal pattern is preferably formed to be extended from one end to the other end of the plurality of level shifters LS arrayed on the substrate SUB. By arranging the metal pattern serving as the wiring line $M_{VSS_B}$ on the top layer, the parasitic capacitance between the wiring line $M_{VSS_B}$ and the signal generating unit SG can be further reduced, and the influence of the aforementioned noise can be further reduced.

The example in FIG. 3 represents an arrangement in which the signal generating unit SG and the wiring line $M_{GNDH_A}$ overlap each other when viewed from the upper side. However, when the signal generating unit SG and the wiring line $M_{GNDH_A}$ are configured not to overlap each other, the influence, on the signal generating unit SG, of noise on the wiring line $M_{GNDH_A}$ can be further reduced.

Second Embodiment

Figure 4:
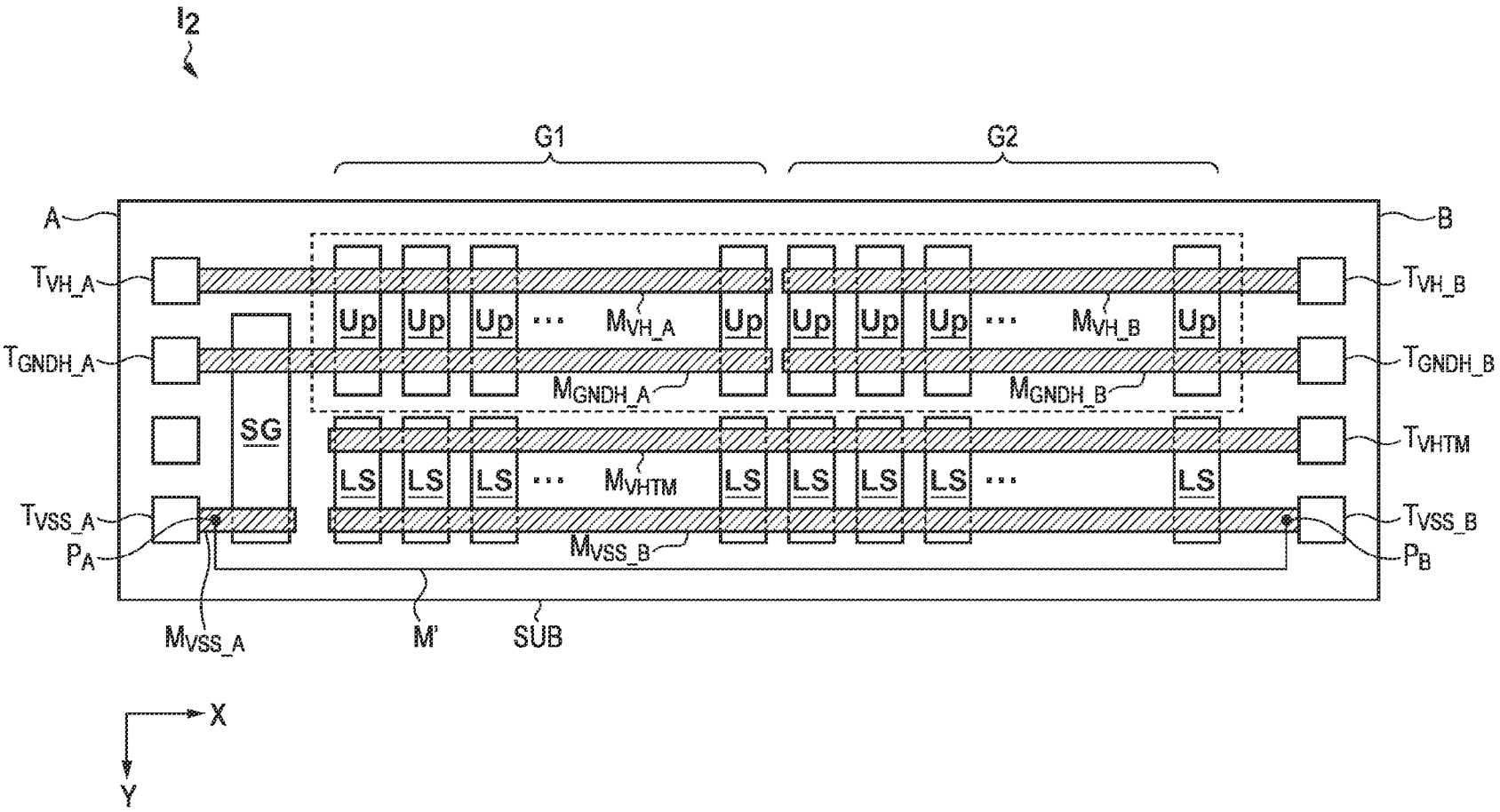
FIG. 4 is a view for explaining an example of the layout of a printhead substrate.

FIG. 4 shows an example of the arrangement of a printhead substrate $I_2$ according to the second embodiment. In this embodiment, wiring lines $M_{VSS_A}$ and $M_{VSS_B}$ are connected by another wiring line M' having a relatively large resistance value. The wiring line M' is arranged not to overlap a signal generating unit SG when viewed from the upper side. The wiring lines M' and $M_{VSS_A}$ are connected between a pad $T_{VSS_A}$ and the signal generating unit SG when viewed from the upper side. In FIG. 4, this connection point is represented by "$P_A$". The wiring lines M' and $M_{VSS_B}$ are connected between a pad $T_{VSS_B}$ and a plurality of level shifters LS when viewed from the upper side. In FIG. 4, this connection point is represented by "$P_B$".

In this case, the resistance value (resistance value from the connection point $P_A$ to the connection point $P_B$) of the wiring line M' is preferably set to be larger than both of the resistance value of the wiring line $M_{VSS_A}$ and that of the wiring line $M_{VSS_B}$. In particular, the resistance value of the wiring line M' is preferably set to be larger than that of the wiring line $M_{VSS_B}$ (for example, 10 times or more).

The second embodiment can also reduce the influence, on the signal generating unit SG, of noise generated on the power supply line of the plurality of level shifters LS, and obtain the same effects as those in the first embodiment.

Third Embodiment

Figure 5A:
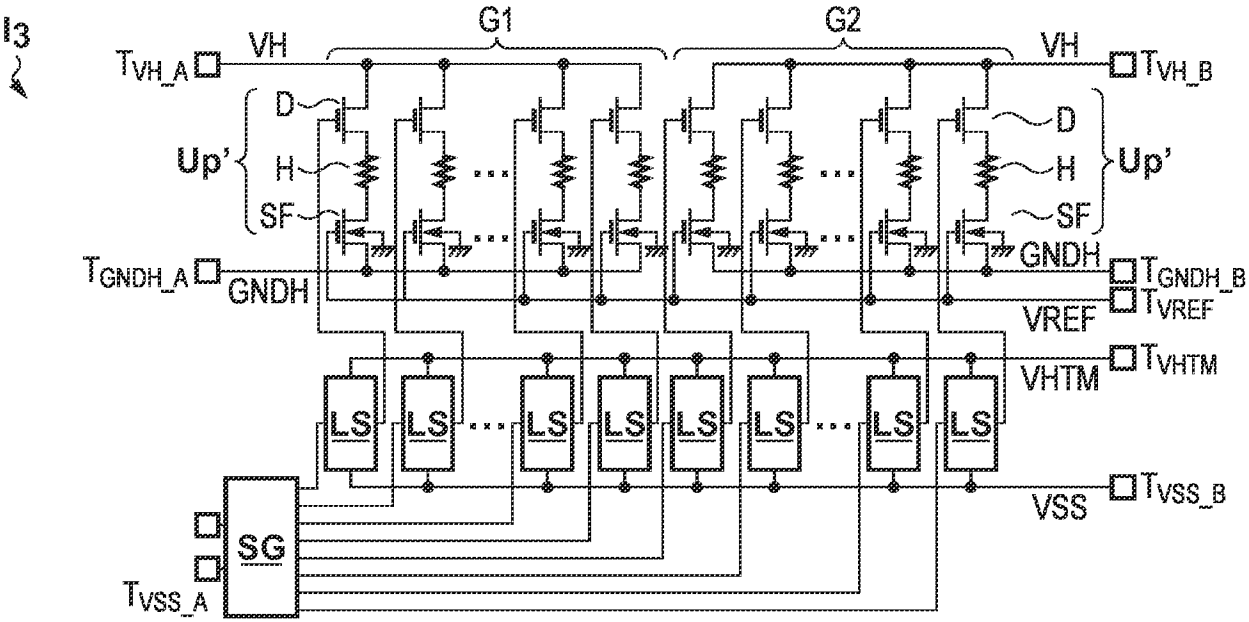
FIGS. 5A and 5B are views for explaining an example of the arrangement of a printhead substrate and an example of the layout.
Figure 5B:
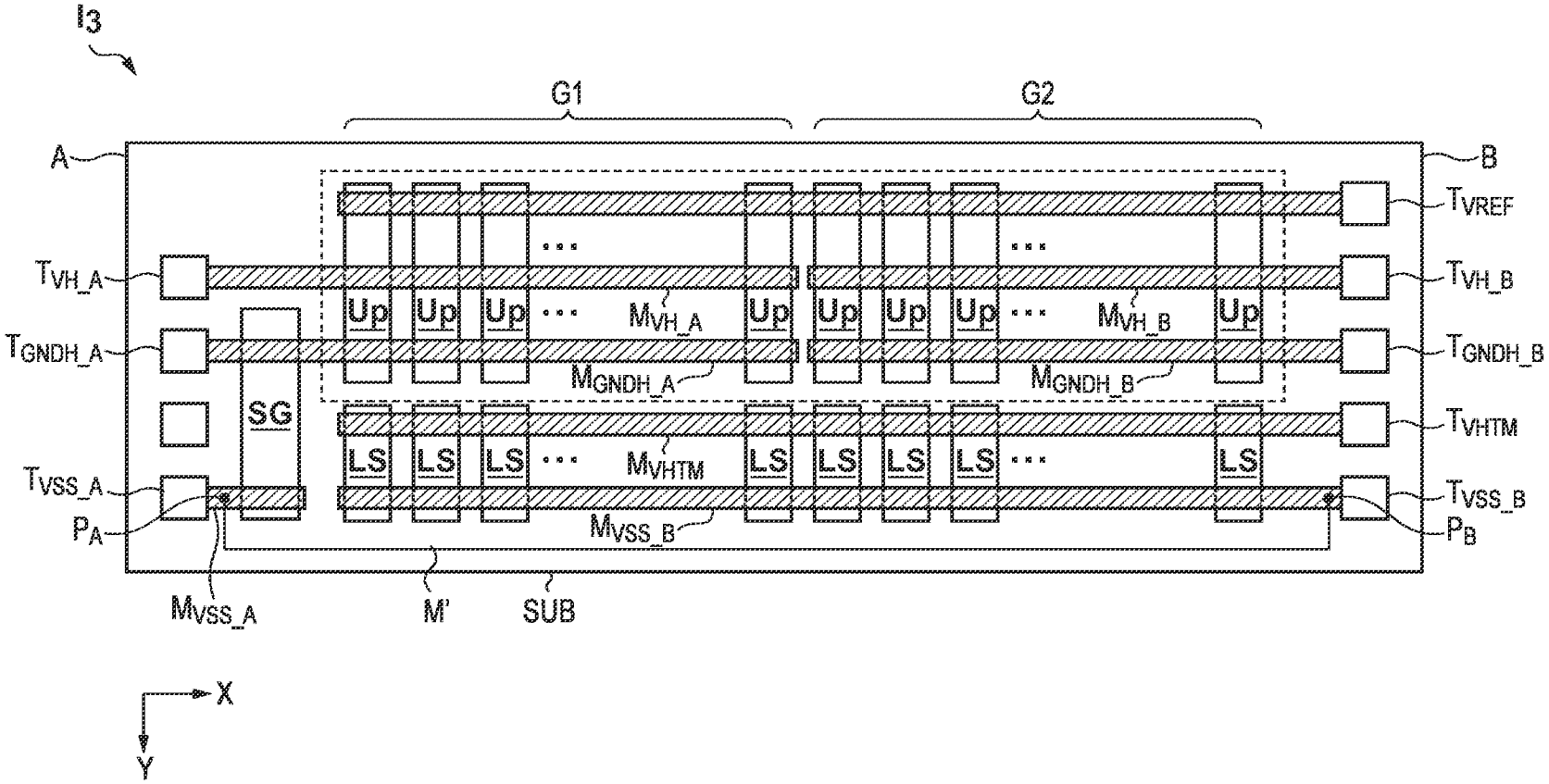

FIGS. 5A and 5B are schematic views respectively showing an example of the arrangement of a printhead substrate $I_3$ and its upper surface layout according to the third embodiment. The third embodiment is different from the second embodiment in that each of a plurality of discharging units $U_P$' further includes a second transistor SF in addition to a heater H and a transistor D.

The second transistor SF receives a constant voltage VREF at the gate and performs a source follower operation. This arrangement can reduce the influence of potential fluctuations of voltages VH and GND on the current amount of the heater H. A pad $T_{VREF}$ for receiving the voltage VREF is arranged on a side B along a side B together with a pad $T_{VH_B}$ and the like, and is electrically connected to the gates of the respective transistors SF of the plurality of discharging units $U_P$'.

On a wiring line $M_{VREF}$ for propagating the voltage VREF, noise can be generated by a potential fluctuation in the transistor SF upon driving the heater H, a potential fluctuation arising from the parasitic capacitance between wiring lines, or the like. Similar to the wiring line $M_{VSS_B}$, the wiring line $M_{VREF}$ is preferably arranged not to overlap a signal generating unit SG when viewed from the upper side. The third embodiment can obtain the same effects as those in the first embodiment, and is advantageous for reducing the influence, on the signal generating unit SG, of noise on the wiring line $M_{VREF}$.

Note that the example in FIG. 5B represents an arrangement in which the wiring lines $M_{GNDH_A}$ and $M_{GNDH_B}$ are arranged on a side close to a level shifter LS, but the wiring line $M_{VREF}$ may be arranged on a side close to the level shifter LS. In this case, the position of the corresponding pad $T_{GNDH_A}$ or the like may be changed. This arrangement can increase the distances between the wiring lines $M_{GNDH_A}$ and $M_{GNDH_B}$ and the signal generating unit SG when viewed from the upper side. Thus, the influence, on the signal generating unit SG, of noise on the wiring lines $M_{GNDH_A}$ and $M_{GNDH_B}$ can be further reduced.

When the printhead substrate $I_3$ includes a voltage generating unit, the voltage VREF may be generated inside the printhead substrate $I_3$ by the voltage generating unit. It suffices to use, for example, a band gap reference for the voltage generating unit. In this case, the pad $T_{VREF}$ need not be arranged.

Fourth Embodiment

Figure 6:
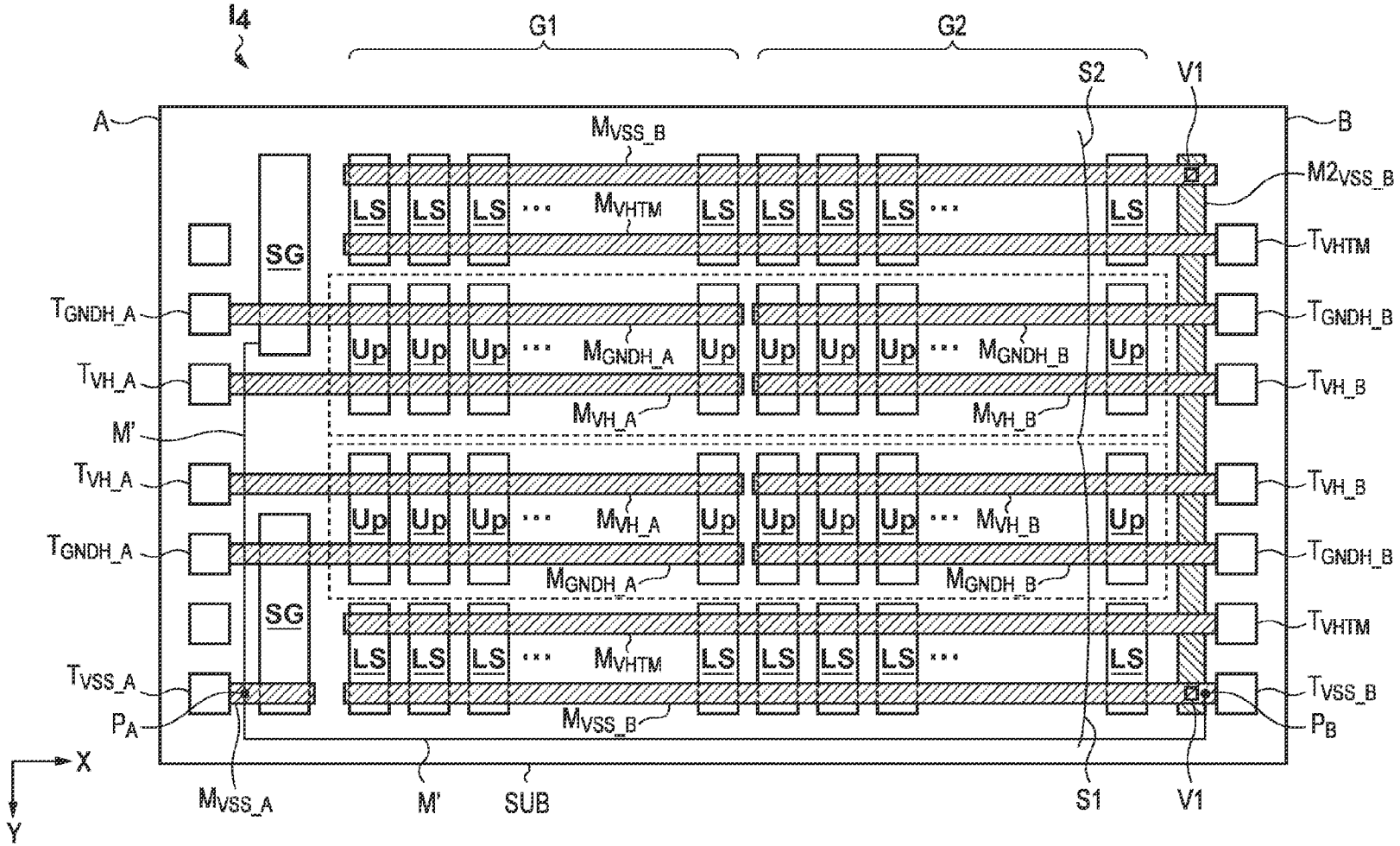
FIG. 6 is a view for explaining an example of the layout of a printhead substrate.

FIG. 6 is a schematic view showing the upper surface layout of a printhead substrate $I_4$ according to the fourth embodiment. The fourth embodiment is different from the second embodiment in that a first set S1 and second set S2 each including a plurality of discharging units $U_P$, a signal generating unit SG, and a plurality of level shifters LS are arranged side by side so as to be adjacent to each other in the Y direction.

In this embodiment, the sets S1 and S2 are formed line-symmetrically. More specifically, the plurality of discharging units $U_P$ of the set S1 and the plurality of discharging units $U_P$ of the set S2 are arranged between the plurality of level shifters LS of the set S1 and the plurality of level shifters LS of the set S2. Pads $T_{HT_A}$, $T_{HT_B}$, $T_{GNDH_A}$, $T_{GNDH_B}$, and $T_{VHTM}$ are arranged at positions corresponding to the sets S1 and S2 formed line-symmetrically.

In this embodiment, two nozzle arrays corresponding to the two sets S1 and S2 are provided in the printhead, and corresponding nozzles of the two nozzle arrays can print dots at one printing position on a printing medium. This arrangement can increase the printing speed and can also increase the color gamut of an image formed on a printing medium.

In this embodiment, the pad $T_{VSS_A}$ is arranged on the side of the set S1 out of the sets S1 and S2, and is shared between the sets S1 and S2 by using a wiring line M'. This arrangement can reduce the number of pads.

Similarly, the pad $T_{VSS_B}$ is arranged on the side of the set S1 out of the sets S1 and S2, and is shared between the sets S1 and S2 by using a wiring line $M2_{VSS_B}$. The wiring line $M2_{VSS_B}$ is arranged on another wiring layer different from that of the wiring line $M_{VSS_B}$, and is extended in the Y direction. The wiring line $M_{VSS_B}$ extended in the X direction and the wiring line $M2_{VSS_B}$ extended in the Y direction are electrically connected to each other through a via V1.

Figure 7:
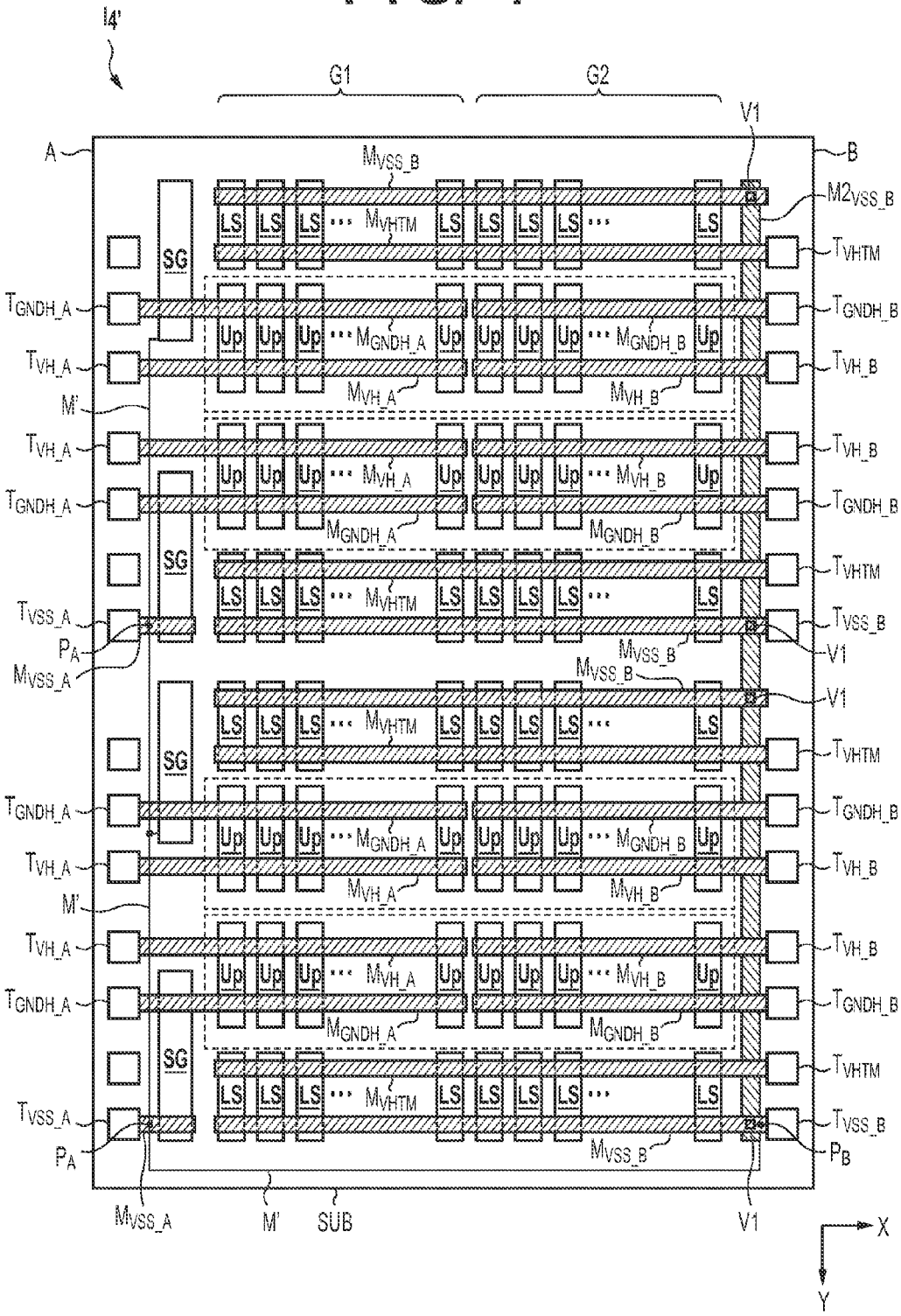
FIG. 7 is a view for explaining an example of the layout of a printhead substrate.

This embodiment has exemplified an arrangement in which the two sets are arranged, but three or more sets may be arranged in the Y direction. FIG. 7 shows an example of a printhead substrate $I_4$' according to another embodiment. FIG. 7 shows an example of an arrangement in which four sets S1 to S4 are arranged in the Y direction.

The fourth embodiment can obtain the same effects as those in the first embodiment, and is advantageous for increasing the printing speed and increasing the color gamut of an image formed on a printing medium.

(Others)

Although several preferable embodiments have been exemplified, the present invention is not limited to them. The embodiments may be partially changed in accordance with the purpose or the like, or respective features of the embodiments may be combined.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-225435, filed Nov. 5, 2014, which is hereby incorporated by reference herein in its entirety.

What is claimed is:

1. A liquid discharging substrate including a plurality of discharging units arrayed on the substrate having a first side and a second side opposite to the first side, comprising:

a first pad configured to receive a first reference voltage, said first pad being arranged on the first side of the substrate;

a second pad configured to receive a second reference voltage equal to the first reference voltage, said second pad being arranged on the second side of the substrate;

a signal generating unit configured to generate a signal for driving the plurality of discharging units, said signal generating unit being arranged between said first pad and said second pad;

a plurality of level shifters configured to shift a level of the signal from said signal generating unit and output the signal to the plurality of discharging units, said plurality of level shifters being arranged between said signal generating unit and said second pad;

a first wiring line configured to supply the first reference voltage received by said first pad to said signal generating unit; and a second wiring line configured to supply the second reference voltage received by said second pad to said plurality of level shifters, wherein said first wiring line and said second wiring line are isolated from each other between said signal generating unit and said plurality of level shifters when viewed from an upper side with respect to an upper surface of the substrate.

2. The substrate according to claim 1, wherein the substrate includes a plurality of wiring layers arranged on the substrate, said second wiring line includes a metal pattern formed on a top wiring layer out of the plurality of wiring layers, and the metal pattern is extended from one level shifter closest to said signal generating unit among said plurality of level shifters to one level shifter farthest from said signal generating unit when viewed from the upper side, and is arranged not to overlap said signal generating unit.

3. The substrate according to claim 1, further comprising another wiring line that electrically connects said first wiring line and said second wiring line, a resistance value of said other wiring line being larger than that of each of said first wiring line and said second wiring line, and said other wiring line being arranged not to overlap said signal generating unit when viewed from the upper side.

4. The substrate according to claim 3, wherein said other wiring line is electrically connected to said first wiring line between said first pad and said signal generating unit, and electrically connected to said second wiring line between said second pad and said plurality of level shifters.

5. The substrate according to claim 1, wherein the first reference voltage and the second reference voltage are ground voltages of said signal generating unit and said plurality of level shifters.

6. The substrate according to claim 1, wherein the plurality of discharging units are divided into a first group on the first side out of the first side and the second side, and a second group on the second side out of the first side and the second side, the substrate further comprises:

a third pad configured to receive a third reference voltage, said third pad being arranged on the first side out of the first side and the second side;

a third wiring line configured to supply the third reference voltage received by said third pad to the individual discharging units of the first group;

a fourth pad configured to receive a fourth reference voltage equal to the third reference voltage, said fourth pad being arranged on the second side out of the first side and the second side; and a fourth wiring line configured to supply the fourth reference voltage received by said fourth pad to the individual discharging units of the second group, and said third wiring line and said fourth wiring line are isolated from each other between the first group and the second group when viewed from the upper side.

7. The substrate according to claim 6, wherein said third wiring line and said fourth wiring line are arranged not to overlap said signal generating unit when viewed from the upper side.

8. The substrate according to claim 1, wherein each of the plurality of discharging units includes an electrothermal transducer, a first transistor configured to receive a signal from said signal generating unit and drive the electrothermal transducer, the first transistor being connected to one end of the electrothermal transducer, and a second transistor configured to supply a constant current to the electrothermal transducer by a source follower operation, the second transistor being connected to the other end of the electrothermal transducer, the substrate further comprises a fifth wiring line configured to supply a constant voltage to a control terminal of the second transistor of each of the plurality of discharging units, and said fifth wiring line is arranged in an array direction of the plurality of discharging units not to overlap said signal generating unit when viewed from the upper side.

9. The substrate according to claim 1, wherein the substrate includes a plurality of sets each including at least the plurality of discharging units, said signal generating unit, said plurality of level shifters, and said second wiring line, the plurality of sets being arranged in a direction perpendicular to an array direction of the plurality of discharging units.

10. A liquid discharging substrate including a plurality of discharging units arrayed on the substrate, comprising:

a first pad configured to receive a first ground voltage, said first pad being arranged on a first side out of the first side and a second side that are opposite to each other on the substrate;

a second pad configured to receive a second ground voltage, said second pad being arranged on the second side out of the first side and the second side;

a signal generating unit configured to generate a signal for driving the plurality of discharging units, said signal generating unit being arranged between said first pad and said second pad;

a plurality of level shifters configured to shift a level of the signal from said signal generating unit and output the signal to the plurality of discharging units, said plurality of level shifters being arranged between said signal generating unit and said second pad;

a first wiring line configured to supply the first ground voltage received by said first pad to said signal generating unit; and a second wiring line configured to supply the second ground voltage received by said second pad to said plurality of level shifters, wherein said first wiring line and said second wiring line are isolated from each other between said signal generating unit and said plurality of level shifters when viewed from an upper side with respect to an upper surface of the substrate.

11. The substrate according to claim 10, wherein a voltage value of the first ground voltage and a voltage value of the second ground voltage are equal to each other.

12. A printhead comprising a printhead substrate, said printhead substrate including:

a plurality of printing units arrayed on the substrate having a first side and a second side opposite to the first side;

a first pad configured to receive a reference voltage, the first pad being arranged on the first side of the substrate;

a second pad configured to receive the reference voltage, the second pad being arranged on the second side of the substrate;

a signal generating unit configured to generate a signal for driving the plurality of printing units, the signal generating unit being arranged between the first pad and the second pad;

a plurality of level shifters configured to shift a level of the signal from the signal generating unit and output the signal to the plurality of printing units, the plurality of level shifters being arranged between the signal generating unit and the second pad;

a first wiring line configured to supply the reference voltage received by the first pad to the signal generating unit; and a second wiring line configured to supply the reference voltage received by the second pad to the plurality of level shifters, wherein the first wiring line and the second wiring line are isolated from each other between the signal generating unit and the plurality of level shifters when viewed from an upper side with respect to an upper surface of the substrate.

13. A printing apparatus comprising a printhead including a printhead substrate, the printhead substrate including:

a plurality of printing units arrayed on the substrate having a first side and a second side opposite to the first side;

a first pad configured to receive a reference voltage, the first pad being arranged on a first side of the substrate;

a second pad configured to receive the reference voltage, the second pad being arranged on the second side of the substrate;

a signal generating unit configured to generate a signal for driving the plurality of printing units, the signal generating unit being arranged between the first pad and the second pad;

a plurality of level shifters configured to shift a level of the signal from the signal generating unit and output the signal to the plurality of printing units, the plurality of level shifters being arranged between the signal generating unit and the second pad;

a first wiring line configured to supply the reference voltage received by the first pad to the signal generating unit; and a second wiring line configured to supply the reference voltage received by the second pad to the plurality of level shifters, wherein the first wiring line and the second wiring line are isolated from each other between the signal generating unit and the plurality of level shifters when viewed from an upper side with respect to an upper surface of the substrate.

* * * * *